US012383112B2

(12) United States Patent
Lugert et al.

(10) Patent No.: US 12,383,112 B2
(45) Date of Patent: Aug. 12, 2025

(54) DOMESTIC DISHWASHER

(71) Applicant: BSH Hausgeräte GmbH, Munich (DE)

(72) Inventors: Michael Lugert, Jettingen-Scheppach (DE); Bernd Eisenbart, Holzheim (DE); Werner Oblinger, Mödingen (DE)

(73) Assignee: BSH Hausgeräte GmbH, Munich (DE)

( * ) Notice: Subject to any disclaimer, the term of this patent is extended or adjusted under 35 U.S.C. 154(b) by 169 days.

(21) Appl. No.: 18/038,228

(22) PCT Filed: Jan. 13, 2022

(86) PCT No.: PCT/EP2022/050611

§ 371 (c)(1),
(2) Date: May 23, 2023

(87) PCT Pub. No.: WO2022/157063

PCT Pub. Date: Jul. 28, 2022

(65) Prior Publication Data

US 2023/0404356 A1 Dec. 21, 2023

(30) Foreign Application Priority Data

Jan. 25, 2021 (DE) ..... 102021200603.5

(51) Int. Cl.
*A47L 15/22* (2006.01)
*A47L 15/42* (2006.01)

(52) U.S. Cl.
CPC ..... *A47L 15/22* (2013.01); *A47L 15/428* (2013.01)

(58) Field of Classification Search
CPC ..... A47L 15/22; A47L 15/23; A47L 15/428
See application file for complete search history.

(56) References Cited

U.S. PATENT DOCUMENTS 1,546,482 A 7/1925 Farmer
1,592,452 A 7/1926 Ferris
(Continued)

FOREIGN PATENT DOCUMENTS

DE 2745644 A * 4/1979 ..... A47L 15/23
DE 3816408 A1 11/1989
(Continued)

OTHER PUBLICATIONS

Machine Translation of Heissmeier et al., DE-2745644-A, Apr. 1979. (Year: 1979).*

(Continued)

*Primary Examiner* — David G Cormier
(74) *Attorney, Agent, or Firm* — Micahel E. Tschupp; Andre Pallapies; Brandon G. Braun

(57) ABSTRACT

A household dishwasher includes a dishwasher cavity and a spray arm designed to supply wash liquor and/or freshwater to dishware received in the dishwasher cavity. The spray arm includes an extension arm which is actively driven by a drive element, and a spray arm satellite which is mounted on the extension arm for rotation about an axis of rotation and includes spray nozzles supplied with wash liquor and/or the freshwater and designed to exit spray jets which rotate the spray arm satellite. The spray nozzles are designed so that force vectors resulting from the exiting spray jets mutually cancel out one another on a plane oriented perpendicularly to the axis of rotation.

10 Claims, 8 Drawing Sheets

(56) References Cited

U.S. PATENT DOCUMENTS

| | | | | |
|---|---|---|---|---|
| 3,538,927 | A * | 11/1970 | Wallgren | A47L 15/23 134/144 |
| 2011/0146734 | A1 | 6/2011 | Rappette | |
| 2016/0198927 | A1* | 7/2016 | Boyer | A47L 15/23 134/172 |
| 2020/0245842 | A1 | 8/2020 | Welch | |

FOREIGN PATENT DOCUMENTS

| | | | |
|---|---|---|---|
| EP | 2679134 | A1 | 1/2014 |
| JP | H05222825 | A | 8/1993 |
| JP | H10127560 | A | 5/1998 |
| WO | 2013132459 | A1 | 9/2013 |
| WO | 2018228679 | A1 | 12/2018 |

OTHER PUBLICATIONS

English Abstract of Heissmeier et al., DE-2745644-A, Apr. 1979. (Year: 1979).*

International Search Report PCT/EP2022/050611 dated Mar. 30, 2022.

National Search Report DE 10 2021 200 603.5 Date Oct. 15, 2021.

* cited by examiner

DOMESTIC DISHWASHER

CROSS-REFERENCES TO RELATED APPLICATIONS

This application is the U.S. National Stage of International Application No. PCT/EP2022050611, filed Jan. 13, 2022, which designated the United States and has been published as International Publication No. WO 2022/157063 A1 and which claims the priority of German Patent Application, Serial No. 10 2021 200 603.5, filed Jan. 25, 2021, pursuant to 35 U.S.C. 119(a)-(d).

The contents of International Application No. PCT/EP2022/050611 and German Patent Application, Serial No. 10 2021 200 603.5 are incorporated herein by reference in their entireties as if fully set forth herein.

BACKGROUND OF THE INVENTION

The present invention relates to a household dishwasher.

A dishwasher comprises a dishwasher cavity, in which a spray arm is mounted for supplying wash liquor to dishware received in the dishwasher cavity. The spray arm can have an extension arm and a spray arm satellite rotatably mounted on the extension arm. The spray arm satellite comprises spray nozzles. Wash liquor exiting the spray nozzles generates a drive torque on the basis of impulse forces in order to rotate the spray arm satellite with respect to the extension arm. On account of these impulse forces, different forces and torques can act in each angular position of the spray arm satellite. This can result in an inhomogeneous, in particular jerky, movement of the spray arm satellite. This has to be improved.

BRIEF SUMMARY OF THE INVENTION

Against this background, one object of the present invention consists in providing an improved household dishwasher.

Accordingly, a household dishwasher is proposed. The household dishwasher comprises a dishwasher cavity and a spray arm for supplying wash liquor and/or freshwater to dishware received in the dishwasher cavity, wherein the spray arm comprises an extension arm which is actively driven by means of a drive element and a spray arm satellite which is rotatably mounted on the extension arm about an axis of rotation, wherein the spray arm satellite comprises spray nozzles supplied with wash liquor and/or the freshwater, wherein spray jets exiting the spray nozzles rotate the spray arm satellite and wherein the spray nozzles are designed so that force vectors resulting from the exiting spray jets mutually cancel out one another on a plane oriented perpendicularly to the axis of rotation.

As a result of the force vectors mutually canceling out one another, a uniform running of the spray arm satellite and also of the extension arm is always ensured. In this way, a dynamic or pulsating load of a bearing of the spray arm satellite on the extension arm and a bearing of the extension arm can itself be prevented. A longer service life with a reduced material usage is therefore possible on account of the more uniform running of the extension arm and of the spray arm satellite.

The dishwasher cavity is preferably cuboid in shape. The dishwasher cavity can have a door which can be opened at the front. The spray arm is preferably rotatably mounted on a base of the dishwasher cavity, in particular on a sump of the dishwasher cavity. The fact that washing liquor and/or freshwater is "supplied" to the dishware means here that the spray arm is designed to wet the dishware with washing liquor and/or freshwater in order to clean the same. The fact that the extension arm is driven "actively" means in particular that the extension arm is not rotated by washing liquor and/or freshwater exiting the spray nozzles. The drive element is instead provided to actively drive the extension arm. The drive element is an electric motor or comprises an electric motor.

Contrary to the extension arm, the spray arm satellite is driven passively. Here "passively" means that the spray arm satellite comprises no drive element, as mentioned previously, but is only rotated by the wash liquor and/or the freshwater exiting from the spray nozzles. The fact that the spray nozzles are "designed" so that their force vectors mutually cancel out one another on the plane means in particular that the spray nozzles are oriented differently in the space and/or permit different volume flows of exiting wash liquor and/or freshwater so that the force vectors cancel out on the plane. A total of the force vectors on the plane amounts accordingly to zero or at least approximately zero.

According to one embodiment, the spray nozzles comprise outlet cross-sections which differ from one another for the wash liquor and/or the freshwater.

For instance, with a larger outlet cross-section, more wash liquor and/or freshwater exits the respective spray nozzle. Accordingly, the corresponding force vector is also larger by comparison with a force vector of a spray nozzle with a smaller outlet cross-section. Alternatively, all spray nozzles can also have an identical outlet cross-section. The outlet cross-section can be a circular geometry, for instance. The outlet cross-section can also be oval, rectangular or slot-shaped, however.

According to a further embodiment, the spray nozzles are tilted differently, viewed in the plane.

For instance, the spray nozzles are tilted so that the force vectors are oriented perpendicularly to arms of the spray arm satellites. However, the spray nozzles can be tilted arbitrarily in contrast to this perpendicular alignment. Alternatively, all spray nozzles can also be tilted identically, viewed in the plane.

According to a further embodiment, the spray nozzles are arranged at different distances from the axis of rotation.

For instance, a spray nozzle with a larger outlet cross-section is positioned closer to the axis of rotation than a spray nozzle with a smaller outlet cross-section by comparison herewith. The resulting force vector of the spray nozzle with the larger outlet cross-section has a smaller lever arm here than the force vector of the spray nozzle with the smaller outlet cross-section.

According to a further embodiment, at least one part of the spray nozzles is oriented perpendicularly to the plane.

With the aid of these spray nozzles, it is in particular possible to wet dishware in a receptacle for dishware arranged above the spray arm with wash liquor and/or freshwater. The spray nozzles are arranged here and designed from their outlet cross-section such that preferably no tilting moment is applied to the spray arm satellite.

According to a further embodiment, the spray arm satellite comprises a number of arms, to which the spray nozzles are attached.

The number of arms is freely selectable. The spray arm satellite preferably comprises at least two arms. However, the spray arm satellite can also have three arms, which are positioned circumferentially at a uniform distance from one another, for instance.

According to a further embodiment, each arm comprises at least one spray nozzle.

This at least one spray nozzle can be oriented perpendicularly to the plane. Each arm preferably comprises a number of spray nozzles, however.

According to a further embodiment, the arms comprise arrangements of spray nozzles which differ from one another.

The "arrangement" can be understood here to mean the spacing of the respective spray nozzles in relation to the axis of rotation. Furthermore, the spray nozzles of the arms can also differ from one another in respect of their outlet cross-sections.

According to a further embodiment, the spray nozzles are provided on the top of the arms.

In addition, spray nozzles can also be provided on the bottom of the arms. These can be suited for instance to cleaning a filter system of the household dishwasher.

According to a further embodiment, at least one part of the spray nozzles is tilted out of the plane.

The spray nozzles can be tilted arbitrarily relative to the plane.

Further possible implementations of the household dishwasher also comprise combinations—not explicitly cited—of features or embodiments described above or below in respect of the exemplary embodiments. Here the person skilled in the art will also add individual aspects as improvements or enhancements to the respective basic form of the household dishwasher.

BRIEF DESCRIPTION OF THE DRAWINGS

Further advantageous embodiments and aspects of the household dishwasher form the subject matter of the subclaims and the exemplary embodiments of the household dishwasher described below. The household dishwasher is also described in greater detail on the basis of preferred embodiments with reference to the attached figures.

DETAILED DESCRIPTION OF EXEMPLARY EMBODIMENTS OF THE PRESENT INVENTION

Figure 1:
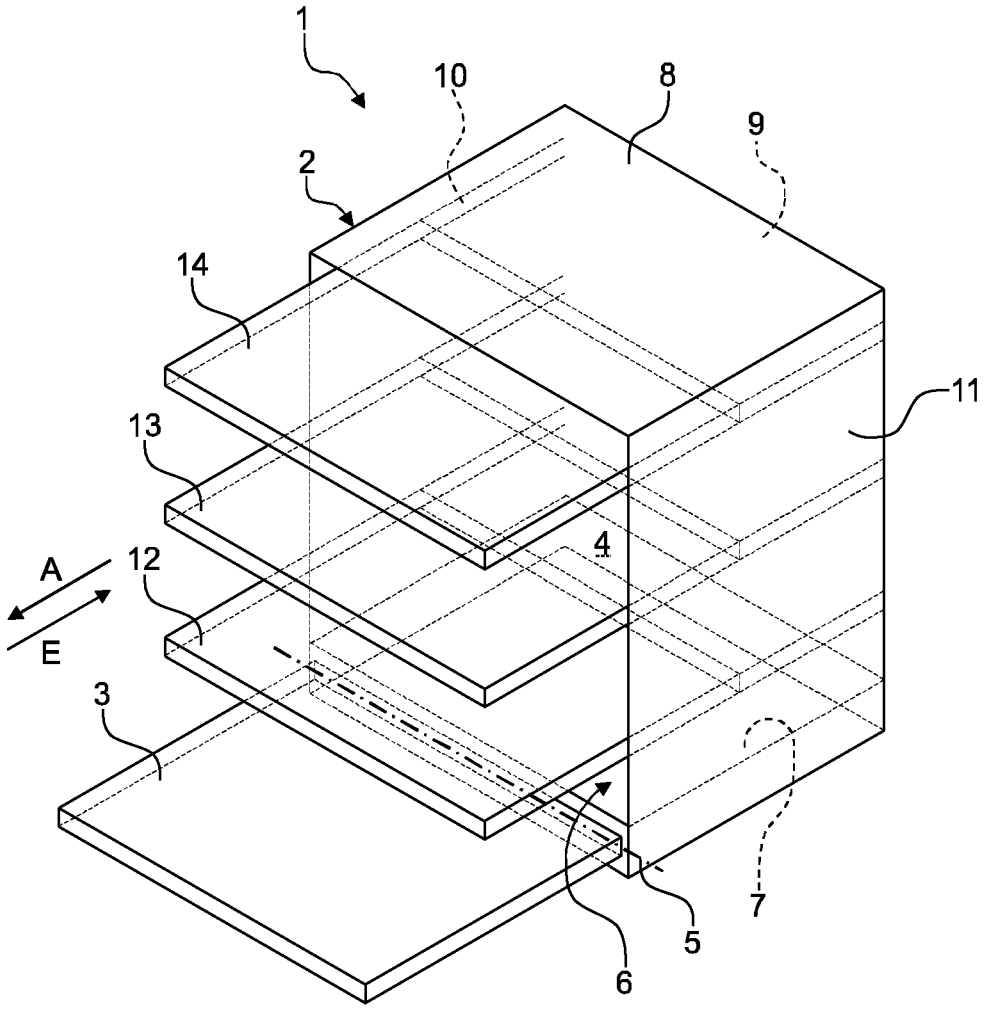
FIG. 1 shows a schematic perspective view of an embodiment of a household dishwasher.

In the figures, elements that are identical or have the same function have been provided with the same reference characters unless otherwise stated.

FIG. 1 shows a schematic perspective view of an embodiment of a household dishwasher 1. The household dishwasher 1 comprises a dishwasher cavity 2, which can be closed by a door 3, in particular in a watertight manner. To this end, a sealing device can be provided between the door 3 and the dishwasher cavity 2. The dishwasher cavity 2 is preferably cuboid in shape. The dishwasher cavity 2 may be arranged in a housing of the household dishwasher 1. The dishwasher cavity 2 and the door 3 may form a washing chamber 4 for washing dishware.

The door 3 is shown in its opened position in FIG. 1. The door 3 can be closed or opened by pivoting about a pivot axis 5 provided on a lower end of the door 3. A loading opening 6 of the dishwasher cavity 2 can be closed or opened with the aid of the door 3. The dishwasher cavity 2 has a base 7, a ceiling 8 arranged opposite to the base 7, a rear wall 9 arranged opposite to the closed door 3, and two side walls 10, 11 arranged opposite to one another. The base 7, the ceiling 8, the rear wall 9 and the side walls 10, 11 can be manufactured from a stainless-steel sheet, for example. Alternatively, the base 7 can be manufactured from a plastic material, for example.

Furthermore, the household dishwasher 1 has at least one receptacle for dishware 12 to 14. A number of, for instance three, receptacles for dishware 12 to 14 can preferably be provided, wherein the receptacle for dishware 12 can be a lower receptacle for dishware or a bottom basket, the receptacle for dishware 13 can be an upper receptacle for dishware or an upper basket, and the receptacle for dishware 14 can be a cutlery drawer. As additionally shown in FIG. 1, the receptacles for dishware 12 to 14 are arranged one above the other in the dishwasher cavity 2. Each receptacle for dishware 12 to 14 is optionally able to be shifted into or out of the dishwasher cavity 2. In particular, each receptacle for dishware 12 to 14 is able to be inserted or pushed into the dishwasher cavity 2 in an insertion direction E and extracted or pulled out from the dishwasher cavity 2 in an extraction direction A opposite to the insertion direction E.

Figure 2:
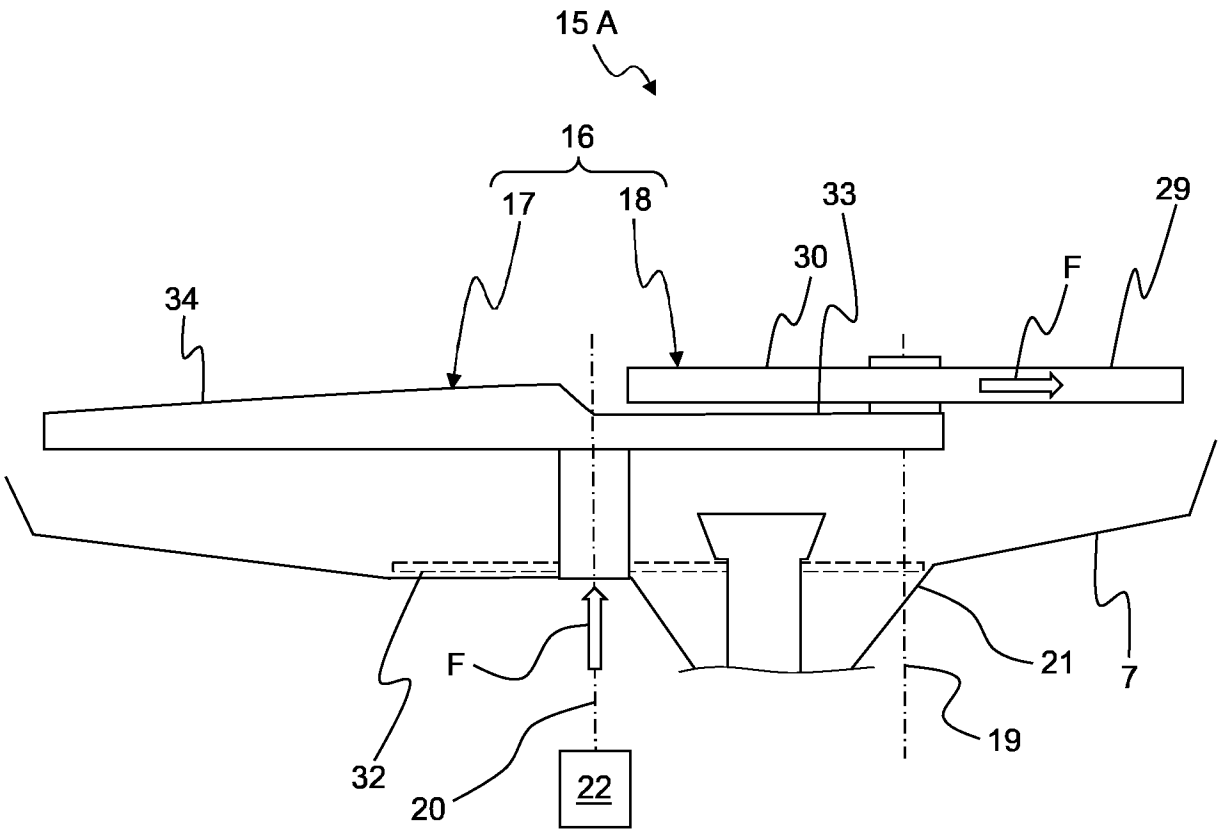
FIG. 2 shows a schematic side view of an embodiment of a spray apparatus for the household dishwasher according to FIG. 1.
Figure 3:
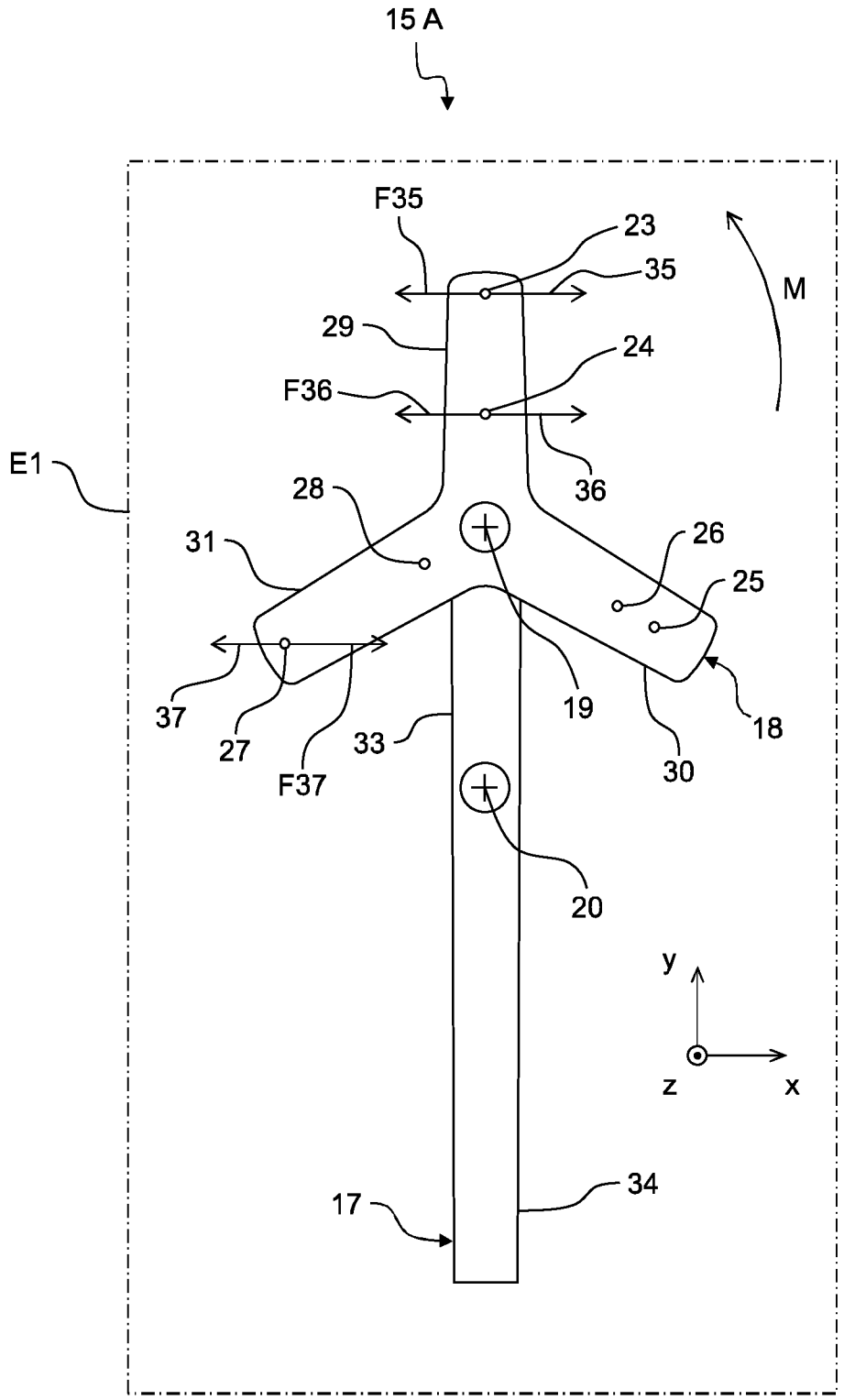
FIG. 3 shows a schematic top view of the spray apparatus according to FIG. 2.

FIG. 2 shows a schematic side view of an embodiment of a spray apparatus 15A for the household dishwasher 1. FIG. 3 shows a schematic top view of the spray apparatus 15A. Reference is made below simultaneously to FIGS. 2 and 3.

The spray apparatus 15A is preferably provided on the base 7 of the dishwasher cavity 2. The spray apparatus 15A comprises a spray arm 16 rotatably mounted with an extension arm 17 and a spray arm satellite 18 mounted rotatably on the extension arm 17. The spray arm satellite 18 is mounted rotatably about an axis of rotation 19 on the extension arm 17. The extension arm 17 in turn is mounted rotatably about an axis of rotation 20 on a pump sump 21 of the household dishwasher 1. The extension arm 17 can however also be mounted on another region or component of the household dishwasher 1. The extension arm 17 is driven actively. To this end, a drive element 22 is provided. The drive element 22 is an electric motor. The spray apparatus 15A comprises the drive element 22 in addition to the spray arm 16.

The spray arm satellite 18 comprises a plurality of spray nozzles 23 to 28. The number of spray nozzles 23 to 28 is freely selectable. For instance, six spray nozzles 23 to 28 are provided, which can be oriented differently. The spray nozzles 23 to 28 are suitable for producing spray jets, with the aid of which wash liquor and/or freshwater F can be supplied to the dishware. The spray nozzles 23 to 28 are provided on the top side of the spray arm satellite 18. Here "on the top side" means facing away from the base 7. However, spray nozzles (not shown) on the bottom side can also be provided on the spray arm satellite 18. Here "on the bottom side" means facing the base 7. The spray nozzles 23 to 28 are preferably provided on one side of the spray arm satellite 18. Alternatively, the spray arm satellite 18 can also have top and bottom side spray nozzles 23 to 28.

The spray arm satellite 18 has a number of arms 29 to 31. The number of arms 29 to 31 is freely selectable. For example, three arms 29 to 31 of this kind are provided, which are arranged at a distance from one another about at an angle of rotation of 120°. However, only two arms 29 to 31 or more than three arms 29 to 31 can also be provided.

A filter system 32 is provided on the pump sump 21. The filter system 32 is multi-part and can comprise a coarse filter and a fine filter, for instance. The extension arm 17 preferably comprises a number of arms 33, 34. Two arms 33, 34 are preferably provided, wherein the spray arm satellite 18 is rotatably mounted on the arm 33 about the axis of rotation 19. However, only one arm 33, 34 may also be provided.

The axes of rotation 19, 20 are positioned parallel to one another and at a distance from one another. The extension arm 17 can likewise have spray nozzles 23 to 28, as mentioned previously. However, this is not necessarily required. The extension arm 17 is actively driven, as mentioned previously. Contrary hereto, the spray arm satellite 18 is not driven actively. In particular, the spray arm satellite 18 is rotated by the wash liquor and/or freshwater F flowing out of the spray nozzles 23 to 28.

The wash liquor and/or freshwater F exiting the spray nozzles 23 to 28 generates a drive torque M on the basis of impulse forces. The drive torque M is oriented counter to the clockwise direction in the orientation in FIG. 3. The drive torque M can however also be oriented conversely. The drive torque M rotates the spray arm satellite 18 with respect to the extension arm 17. The pulse forces are transferred both to a bearing of the spray arm satellite 18 on the extension arm 17 and also to a bearing of the extension arm 17 itself. This can result in different forces and torques acting on the bearings at each angular position of the spray arm satellite 18. This results in a non-uniform running of the spray arm satellite 18 and consequently in an undesirable dynamic load. This has to be improved.

To this end, the spray nozzles 23 to 28 are designed both in respect of their orientation in the space and also with regard to a volume flow of wash liquor and/or freshwater F exiting from the respective spray nozzle 23 to 28 such that forces resulting from the exiting of the wash liquor and/or the freshwater F are approximately zero in each angular position of the spray arm satellite 18 and as a result mutually cancel out one another. The drive torque M of the spray arm satellite 18 which always remains constant and does not change as a function of the angular position is as a result once more transferred to the extension arm 17.

As FIG. 3 shows, the spray arm satellite 18 comprises two spray nozzles 23, 24 on its arm 29, said spray nozzles generating spray jets 35, 36 which are oriented counter to a direction of rotation of the spray arm satellite 18. The spray nozzles 23, 24 are oriented here tilted with respect to the arm 29. Force vectors F35, F36 which rotate the spray arm satellite 18 result from the spray jets 35, 36. The force vectors F35, F36 lie in a plane E1 which spans from an x-direction x and a y-direction y.

Furthermore, the spray arm satellite 18 comprises spray nozzles 25, 26 provided on the arm 30, which are oriented perpendicularly to the arm 30 and thus along a z-direction z. The spray nozzles 25, 26 do not contribute to the drive torque M, since these do not generate force vectors arranged in the plane E1. A spray nozzle 28 is provided on the arm 31, said spray nozzle being oriented perpendicularly like the spray nozzles 25, 26 and thus along the z-direction.

A spray nozzle 27 is further provided on the arm 31, which is arranged so that its spray jet 37 is arranged parallel and opposite to the spray jets 35, 36 of the spray nozzles 23, 24. The spray nozzle 27 therefore has a tilt for generating the drive torque M and a tilt radially outward. A force vector F37 results from the spray jet 37.

The force vectors F35, F36, F37 all lie in the plane E1 and mutually cancel out one another so that a force resulting from the force vectors F35, F36, F37 equates to zero or is approximately zero. This applies to each angular position of the spray arm satellite 18. A dynamic load of components of the spray arm 16 is therefore reliably prevented.

Figure 4:
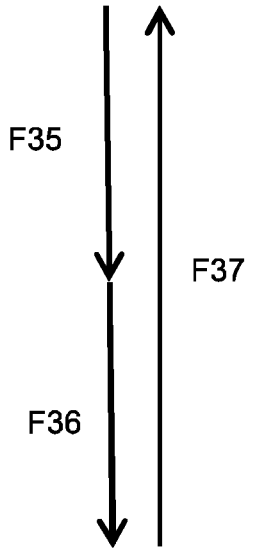
FIG. 4 shows a force polygon of forces acting on the spray apparatus according to FIG. 2.
Figure 5:
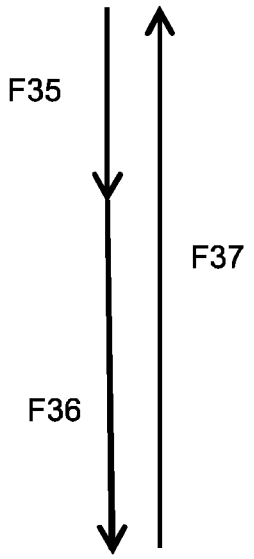
FIG. 5 shows a further force polygon of forces acting on the spray apparatus according to FIG. 2.

FIG. 4 and FIG. 5 each show by way of example how the force vectors F35, F36, F37 mutually cancel out one another. In the example according to FIG. 4, the force vectors F35, F36 are of the same size. In the example according to FIG. 5, the force vectors F35, F36 are of a different size. This difference can result from the spray nozzles 23, 24 having different outlet cross-sections for the wash liquor and/or the freshwater F.

With this previously explained design of the spray nozzles 23 to 28, a longer service life with a reduced material usage is possible on account of the more uniform running of the extension arm 17. Bearing wear is reduced. A pulsating or dynamic load on an overall drivetrain, which may comprise the drive element 22, a gearbox and a seal, is avoided. This further produces a visually attractive running of the extension arm 17.

Figure 6:
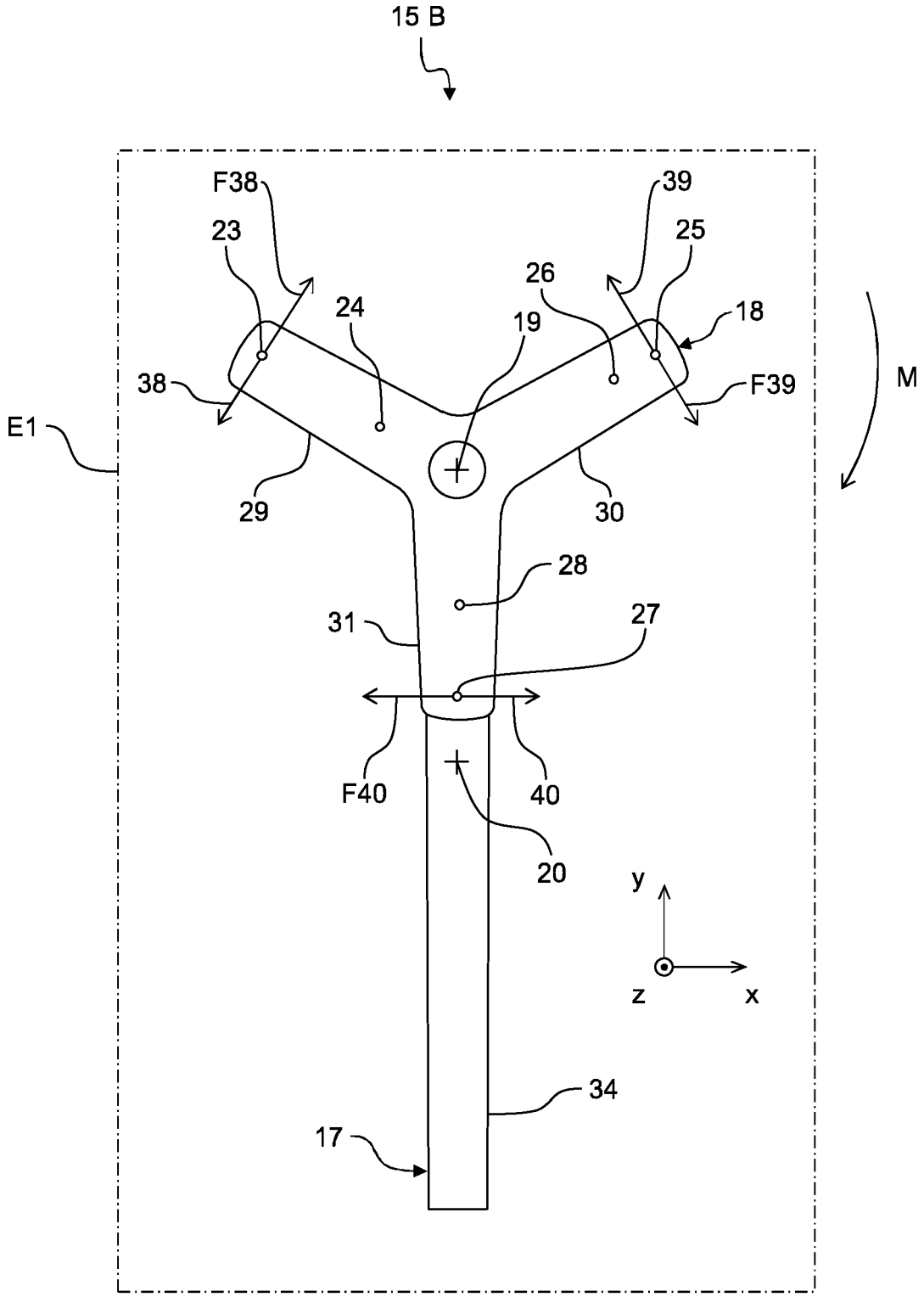
FIG. 6 shows a schematic view of a further embodiment of a spray apparatus for the household dishwasher according to FIG. 1.

FIG. 6 shows a schematic top view of a further embodiment of a spray apparatus 15B. in terms of its design, the spray apparatus 15B substantially corresponds to the design of the spray apparatus 15A. Reference is only made below to differences in the spray apparatuses 15A, 15B.

The spray apparatus 15B comprises spray nozzles 24, 26, 28 on its spray arm satellite 18, which are oriented perpendicularly upward, in other words along the z-direction z. These spray nozzles 24, 26, 28 therefore have no part in the drive torque M for driving the spray arm satellite 18. However, the spray nozzles 24, 26, 28 are designed so that the wash liquor and/or the freshwater F exiting herefrom does not apply a pull-out torque to the spray arm satellite 18.

Figure 7:
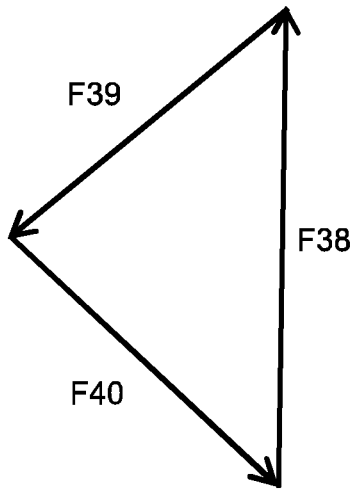
FIG. 7 shows a force polygon of forces acting on the spray apparatus according to FIG. 6.
Figure 8:
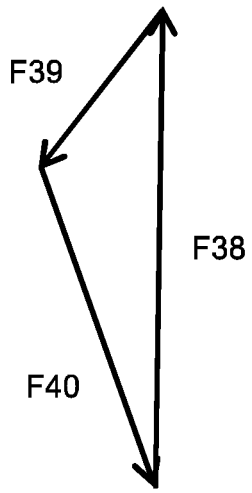
FIG. 8 shows a further force polygon of forces acting on the spray apparatus according to FIG. 6.

Furthermore, each arm 29, 30, 31 comprises a spray nozzle 23, 25, 27, which is aligned in each case so that a spray jet 38, 39, 40 oriented perpendicularly to the respective arm 29, 30, 31 is generated. The spray jets 38, 39, 40 lie in the plane E1 and generate force vectors F38, F39, F40, which generate the drive torque M. The force vectors F38, F39, F40 lie in the plane E1 which spans from the x-direction and the y-direction. As shown in FIGS. 7 and 8, the total of all force vectors F38, F39, F40 in the plane E1 is zero. The spray nozzles 23, 27 have a shared radius of action. In other words, the spray nozzles 23, 25, 27 all have the same distance from the axis of rotation 19. For instance, the force vectors F38, F39, F40 each amount to 0.3 N. FIGS. 7 and 8 each show by way of example how the force vectors F38, F39, F40 cancel out one another.

Figure 9:
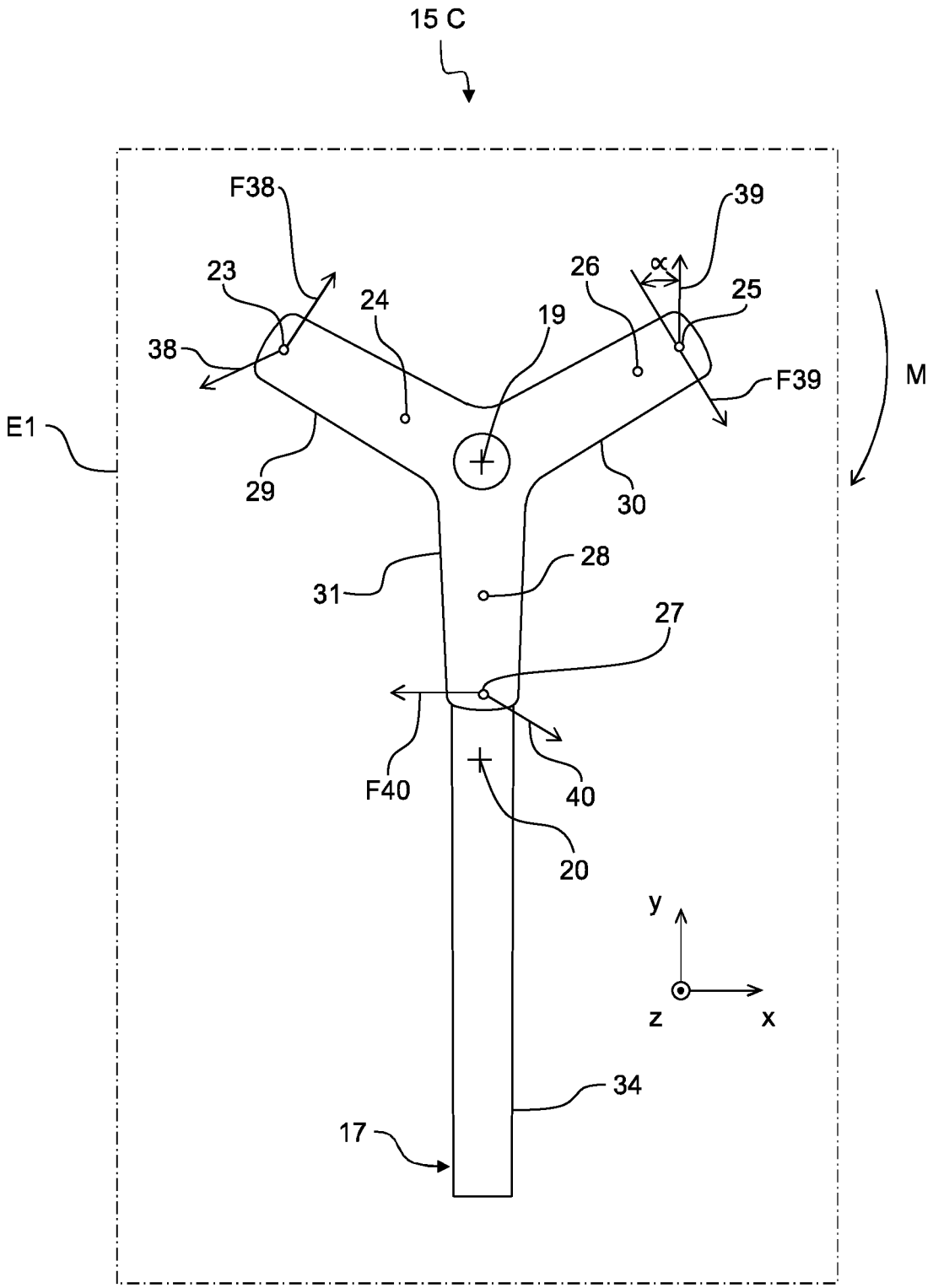
FIG. 9 shows a schematic view of a further embodiment of a spray apparatus for the household dishwasher according to FIG. 1.

FIG. 9 shows a schematic top view of a further embodiment of a spray apparatus 15C. In terms of its design the spray apparatus 15C substantially corresponds to the design of the spray apparatus 15B. Reference is only made below to differences in the spray apparatuses 15B.

The spray arm satellite 18 comprises spray nozzles 24, 26, 28, which are oriented perpendicularly to the spray arm satellite 18 and thus along a z-direction z. The spray nozzles 24, 26, 28 are designed with respect to their radius of action, in other words their distance from the axis of rotation 19 and their diameter, so that each arm 29, 30, 31 has the same torque in the z-direction.

Furthermore, spray nozzles 23, 25, 27 are provided, which are used to drive the spray arm satellite 18. Contrary to the spray apparatus 15B, the spray nozzles 23, 25, 27 are outwardly tilted about a tilt angle α of 15 to 30°. In this way, it is possible to dispense with a fan nozzle which is tilted by 45° for corner cleaning purposes. The spray nozzles 23, 25, 27 generate spray jets 38, 39, 40 and resulting force vectors F38, F39, F40. The force vectors F38, F39, F40 have a sum of 0.3 N in each case for instance.

Figure 10:
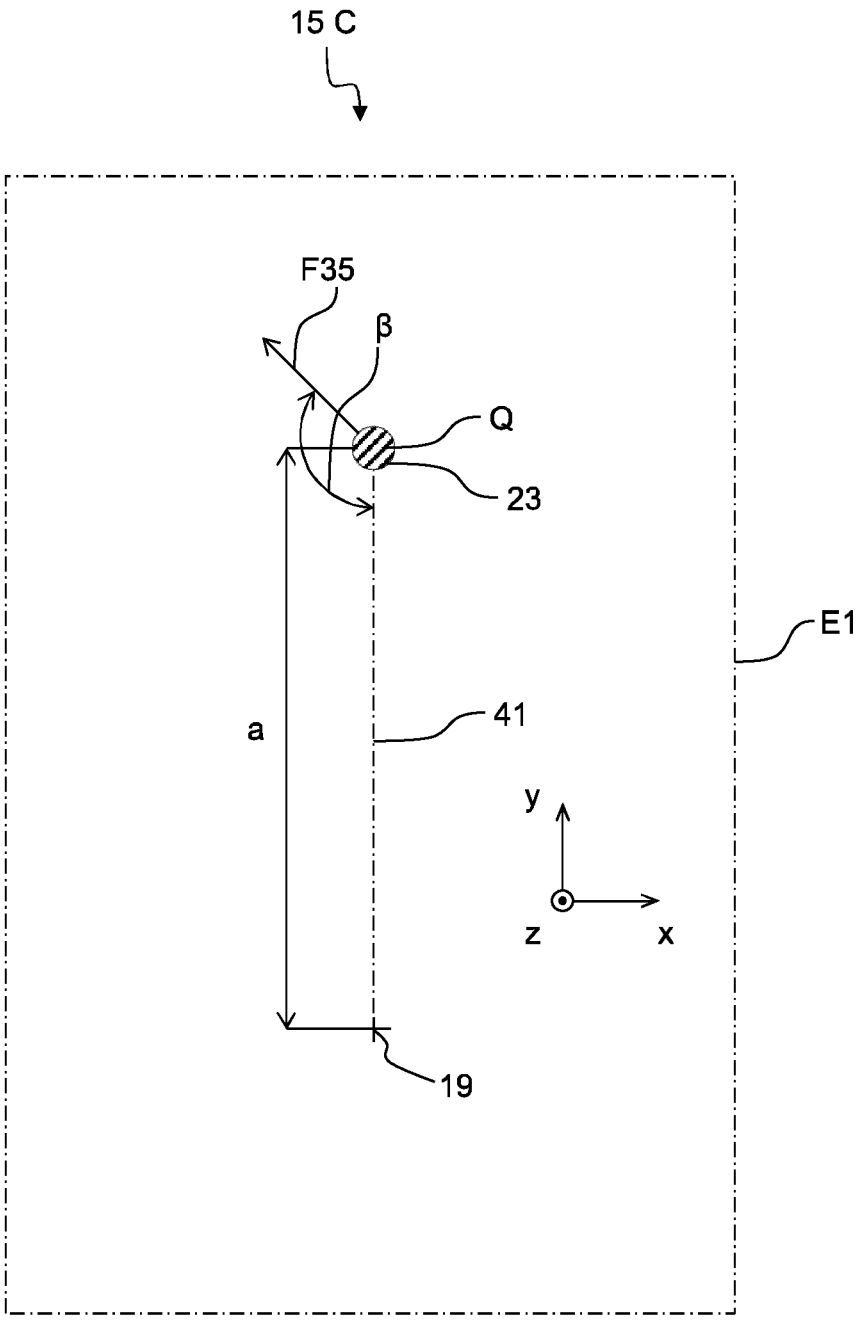
FIG. 10 shows a further very simplified schematic view of the spray apparatus according to FIG. 9.

FIG. 10 shows by way of example on the basis of the spray nozzle 23 how the spray nozzles 23 to 28 can be modified in order to achieve the aim of the total of all force vectors F38, F39, F40 in the plane E equating to zero. A distance a between the axis of rotation 19 and the spray nozzle 23 can be changed in order to increase or decrease the size of the radius of action of the spray nozzle 23. The greater the distance a, the larger the lever arm, with which the force vector F35 assigned to the spray nozzle 23 acts on the respective arm 29, 30, 31 of the spray arm satellite 18.

Furthermore, a tilt angle β of the force vector F35 arranged in the plane E1 can be changed by a corresponding alignment of the spray nozzle 23. The tilt angle β is defined as an angle which spans between a connecting straight line 41 and the respective force vector F35. An outlet section Q, shown dashed in FIG. 10, of the spray nozzle 23 can also be changed. The larger the outlet section Q, the more wash liquor and/or freshwater F can exit from the spray nozzle 23 per time unit.

Although the present invention was described on the basis of exemplary embodiments, it can be modified in a variety of ways.

The invention claimed is:

1. A household dishwasher, comprising:

a dishwasher cavity;

a spray arm designed to supply wash liquor and/or freshwater to dishware received in the dishwasher cavity, said spray arm comprising an extension arm and a spray arm satellite mounted on the extension arm for rotation about a first axis of rotation and comprising spray nozzles supplied with wash liquor and/or the freshwater and designed to exit spray jets which rotate the spray arm satellite, the extension arm positionable to be rotated about a second axis of rotation that is different from the first axis of rotation, said spray nozzles are designed so that force vectors resulting from the exiting spray jets mutually cancel out one another on a plane oriented perpendicularly to the first axis of rotation, wherein the first axis of rotation is located at a first position on the spray arm and the second axis of rotation is parallel to the first axis of roation and located at a second position on the spray arm that is different than the first position; and a drive element designed to actively drive the extension arm of the spray arm about the second axis of rotation.

2. The household dishwasher of claim 1, wherein the spray nozzles comprise outlet cross-sections which differ from one another for the wash liquor and/or the freshwater.

3. The household dishwasher of claim 1, wherein the spray nozzles are tilted differently when viewed in the plane.

4. The household dishwasher of claim 1, wherein the spray nozzles are arranged at different distances from the first axis of rotation.

5. The household dishwasher of claim 1, wherein at least one part of the spray nozzles is oriented perpendicularly to the plane.

6. The household dishwasher of claim 1, wherein the spray arm satellite comprises a number of arms, to which the spray nozzles are attached.

7. The household dishwasher of claim 6, wherein each arm of the number of arms comprises at least one of the spray nozzles.

8. The household dishwasher of claim 6, wherein the number of arms comprise arrangements of the spray nozzles which differ from one another.

9. The household dishwasher of claim 6, wherein the spray nozzles are provided on top of the number of arms.

10. The household dishwasher of claim 1, wherein at least one part of the spray nozzles is tilted out from the plane.

* * * * *